US007444714B2

(12) United States Patent
Lenz

(10) Patent No.: US 7,444,714 B2
(45) Date of Patent: Nov. 4, 2008

(54) AUTOMATIC CORRAL GATE CLOSURE

(75) Inventor: Donald Lenz, Vibank (CA)

(73) Assignee: Prairie Valley Mfg Inc., Vibank Saskatchewan (CA)

( * ) Notice: Subject to any disclaimer, the term of this patent is extended or adjusted under 35 U.S.C. 154(b) by 0 days.

(21) Appl. No.: 11/223,318

(22) Filed: Sep. 12, 2005

(65) Prior Publication Data

US 2007/0056142 A1 Mar. 15, 2007

(51) Int. Cl.
*E05F 1/00* (2006.01)

(52) U.S. Cl. ..... 16/71; 16/72; 16/84; 16/85; 16/280; 16/298

(58) Field of Classification Search ..... 16/71, 16/72, 84, 82, 85, 50, 54, 280, 285, 298–303; 256/26, 73; 49/208, 236, 240
See application file for complete search history.

(56) References Cited

U.S. PATENT DOCUMENTS 1,847,822 A * 3/1932 Denton ..... 49/386
2,118,722 A * 5/1938 Bock ..... 49/364
3,411,241 A * 11/1968 Harmon ..... 49/386
4,616,799 A * 10/1986 Rebentisch ..... 248/289.31
4,817,242 A * 4/1989 Rapp ..... 16/300
5,133,152 A * 7/1992 Grancagnolo ..... 49/239
5,673,459 A * 10/1997 Baghdasarian ..... 16/308
6,477,736 B1 * 11/2002 Abernathy ..... 16/72
6,715,182 B2 * 4/2004 Cheng ..... 16/280

* cited by examiner

*Primary Examiner*—William L. Miller

(57) ABSTRACT

A ranch gate arm assembly which incorporates a gate arm that is mounted to allow swivelling about a longitudinal pivot when an external man or machine force is applied to either side of the gate arm thereby inducing the gate arm to swing out, and two torsion springs, one assembled on each side of the ranch gate arm which push against correlating sides of the gate and push the gate back to a center position after the external force has passed completely through the opening. This gate arm assembly is equipped with a smoothing release assembly, which eliminates the jolt force caused by the quick returning of the gate assembly to the center position that the gate was originally in before the external force was applied.

1 Claim, 2 Drawing Sheets

Fig #1
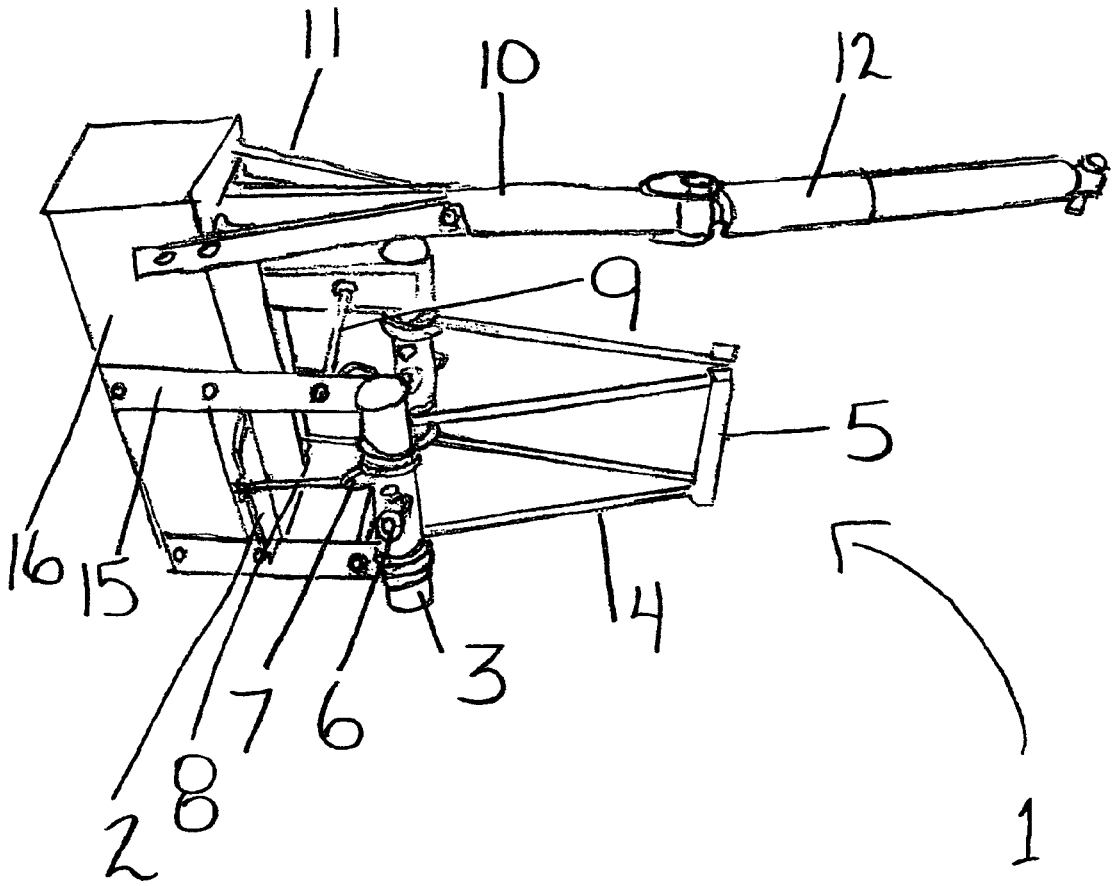

FIG #2
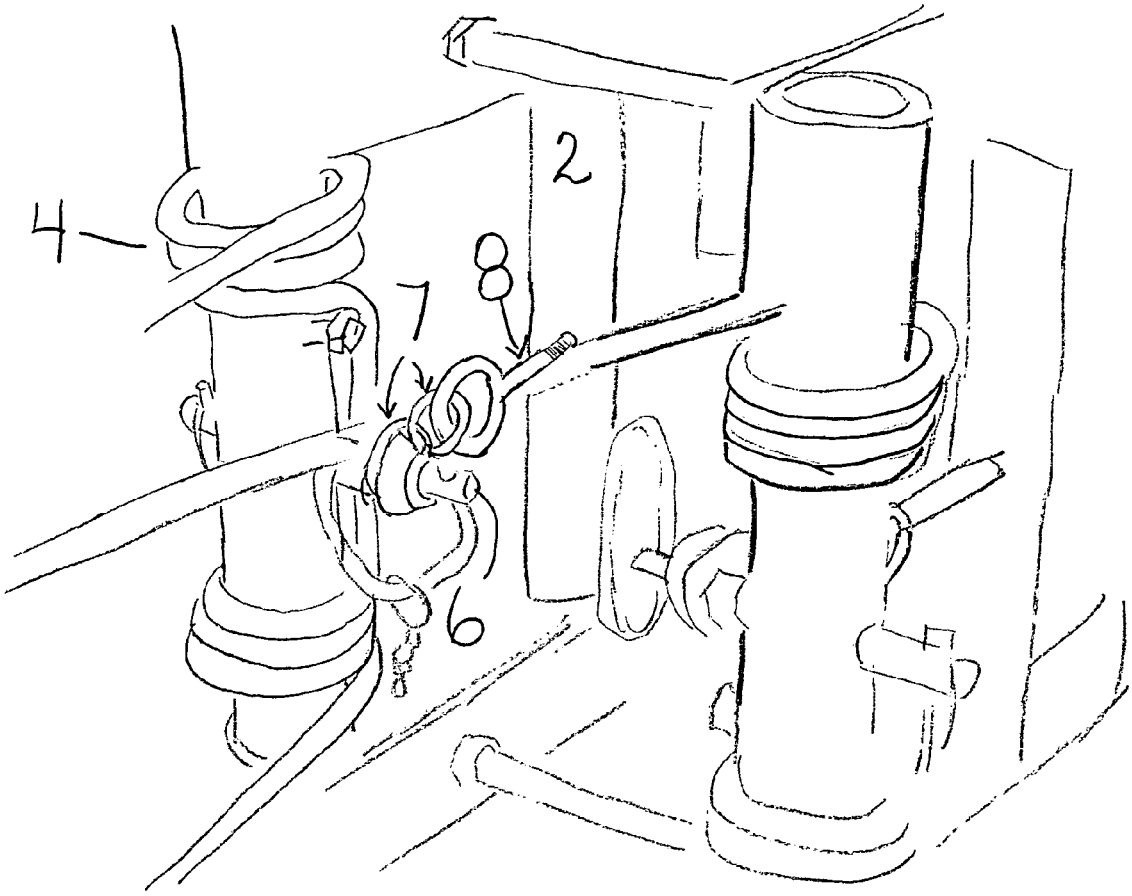

AUTOMATIC CORRAL GATE CLOSURE

FIELD OF THE INVENTION

The present invention relates to an agriculture/rancher gate arm which is used at higher traffic machinery entrances to and from the pasture and corral containment areas for livestock and such.

More specifically, the invention relates to a swivel class gate arm, which is mounted to allow pivoting longitudinally when an external force is applied to either side of the mechanism. There are prior art mechanisms disclosed that attempt to perform this action, but they do not attempt to control the return of the spring loaded gate arms in a safe manner.

The purpose of this invention is to provide an automatic gate closer that is controlled by a smoothening damper that will provide safety for family members and pets.

Thus, it is an object of the present invention to provide a swivel spring adapted assembly, which will safely return a gate arm to a fully closed neutral position in the absence of external forces.

The foregoing objects and advantage of the invention will be apparent from the following description of a preferred embodiment thereof, taking conjunction with the accompanying drawings.

BACKGROUND OF THE INVENTION

Small and large scale livestock producers are constantly going in and out of their corrals either on foot or while driving a farm implement. Every time they choose to move thru these corrals, they physically have to get off the vehicle, move it through the gate, get back off, close the gate and then proceed back onto their vehicle. These producers are constantly looking for ways to make their operations more efficient. Another clear fact is the aging producer is not able to or fond of all the effort required to get on and off of implements.

There are very few innovative ideas presently available to correct this waste of effort required to efficiently get through a corral gate that safely closes automatically behind you.

SUMMARY OF THE INVENTION

According to its major aspects and broadly stated, the present invention is an apparatus for providing an improved method for farm implements to go through gates, and have them automatically close without getting off the implement.

When the apparatus is installed for use, the frame assembly and the shock absorber assembly are fastened to the wooden gate stake post. Once these assemblies are attached to the post, the steel gate is slid between the two spring assemblies and attached also to the primary gate stake post. The latter steel gatepost must be positioned far enough away from the gatepost to allow the steel gate the capability of swivelling axially when a force is applied.

In a preferred embodiment, the improved gate arm is attached to the gate mechanism through a swivel bracket and is maintained in a preferred axis by the centering force of the springs in the swivel frame assembly all the while the action being dampened by the shock absorber assembly.

BRIEF DESCRIPTION OF THE DRAWINGS

FIG. #1 is an elevational view of the Automatic Gate Closer.

FIG. #2 is a View of Spring Tension Eyebolt.

DETAILED DESCRIPTION OF THE INVENTION

FIG. 1 is an elevational view showing a swivel assembly 1, whereby the mentioned frame of the assembly is attached by lag bolt fasteners to the stationary wood post 16 of the corral. The metal gate is attached with pivot points above and below the gate closer mechanism.

Thus, when a horizontal machine force engages the gate arm, it will tend to pivot the gate, which will induce pressure on the effected square tubing 5, which in turn administers pressure on the harrow tine springs 4. The more the vehicle moves into the gate area forcing the gate open the more the force on the harrow tine springs 4. The springs 4 are attached to the swivel assembly 1 first by sliding pin 6.

FIG. 1 shows a spring bracket weldment which is the edifice for supporting the controlled movement of a gate arm. The spring bracket weldment includes the tube 3, which is welded to a strap fabricated plate 15. The swivel assembly 1, has two spacer bolt assemblies 9, which controls the front space between the two mirror image swivel assemblies 1.

It is at this point that I will describe the spring factors, which have been designed to control the returning of the gate to the normal position after the ranch vehicle has passed through it. The force on the harrow tine springs 4 and square tubing 5 will be at its maximum when the gate is fully open. This force will propel the gate back to its original position.

It is now that I will describe the smoothing action of the shock absorber 12. The sub assembly of round tubing 10 and two metal straps 11 are fabricated to be the solid support system for the dampening mechanism. The round tubing 10 has an anchor plate welded to one end, which creates the mounting brace required to secure it to the corral wood post 16. On the opposite end of the metal tube assembly is located two welded oval plates fabricated above and below, designed to provide a support swivel anchor for the shock absorber 12. This support plate must allow the absorber to swivel approximately 180 degrees. This entire mechanism is designed to provide a smooth regulated slower return of the gate to its original position.

The two metal straps 11 are designed to give maximum support to anchor the shock absorber 12. These straps provide the strength by containing the triangular support on each side of the shock absorber assembly.

At this point in the detailed description, I will describe the spring tension eyebolt assembly. FIGS. 1 and 2 show this assembly. The sliding pin 6 runs through the tube 3. This sliding pin 6 holds the spring intact on the outside of the mechanism and provides an anchor for the chain link 7, which is slid through the open end of the eyebolt 8. The threaded part of the eyebolt 8 is threaded through the right angle brace mechanism 2, whereby the eyebolt nut is secured at whatever tension is required to keep the harrow tine springs 4 firm against the gate. The importance of this mechanism is ultimate. As spring permeability changes this mechanism can be tightened or loosened in union with different temperatures apparent for all the different seasons of the year.

Since various modifications could be made in my invention herein above described, and many apparently widely different embodiments of same made within the spirit and scope of the claims without department from such spirit and scope, it is intended that all matter contained in the accompanying specification shall be interpreted as illustrated only and not in a limiting sense.

The invention claimed is:

1. An automatic gate closer for use with a gate member to provide for automatic directing of the gate member to a center closed position when the gate member is released from its open position after the gate member has been pressed either inwardly or outwardly away from the closed position, the gate closer comprising:

a pair of upper spaced plates and a pair of lower spaced plates each horizontally mounted to a stationary post;

a respective spacer bolt assembly connected to the adjacent upper plates and to the adjacent lower plates, the respective spacer bolt assembly controlling the spacing between the adjacent upper plates and the adjacent lower plates;

at least one brace secured to at least one of the plates, the at least one brace having an aperture therein for receiving a threaded end of an eyebolt;

at least one harrow tine spring interconnected with at least one tube proximate the post and a square tubing distant from the post, the at least one tube being secured to at least one of the plates;

a sliding pin passing through the at least one tube;

a chain link connecting the sliding pin to the eyebolt;

a round tubing having a first end attached to the post and a second end pivotally attached to a shock absorber; and two metal straps each attached at a first end to the post and at a second end to the round tubing.

* * * * *